United States Patent [19]

Sandbank

[11] 4,175,664

[45] Nov. 27, 1979

[54] SEAL ARRANGEMENT FOR A SEPARATING MECHAMISM

[75] Inventor: Hans A. Sandbank, London, England

[73] Assignee: GEC Medical Equipment Limited, Wembley, England

[21] Appl. No.: 876,869

[22] Filed: Feb. 13, 1978

[30] Foreign Application Priority Data

Feb. 25, 1977 [GB] United Kingdom ..... 8044/77

[51] Int. Cl.[2] ..... B07C 9/00

[52] U.S. Cl. ..... 209/657

[58] Field of Search ..... 209/606, 638, 656, 657; 308/36.1

[56] References Cited

U.S. PATENT DOCUMENTS

| | | | |
|---|---|---|---|
| 3,137,392 | 6/1964 | Slight | 209/657 X |
| 3,209,910 | 10/1965 | Palmer et al. | 209/657 |
| 3,495,707 | 2/1970 | Davies | 209/657 X |
| 3,552,809 | 1/1971 | Owens | 308/36.1 X |
| 3,829,173 | 8/1974 | Stedman | 308/36.1 X |

FOREIGN PATENT DOCUMENTS

| | | | |
|---|---|---|---|
| 1423552 | 2/1976 | United Kingdom | 209/657 |

*Primary Examiner*—Joseph J. Rolla

*Attorney, Agent, or Firm*—Kirschstein, Kirschstein, Ottinger & Cobrin

[57] ABSTRACT

A movable finger separating unit (e.g. for separating root crops from stones during harvesting) wherein the separating finger is disposed outside a casing which houses an operating mechanism for the finger. Motion is transmitted from the operating mechanism to the finger via an axially rotatable shaft extending through the casing via a rotary seal arrangement so that the casing may be sealed to protect the operating means against dirt.

7 Claims, 3 Drawing Figures

SEAL ARRANGEMENT FOR A SEPARATING MECHAMISM

This invention relates to a separating mechanism for use in apparatus for separating solid objects of a particular kind from a mixture of solid objects of various kinds, for example, for separating root crops from stones, clods of earth and the like, or for mineral separation.

In such an apparatus the mixture of objects typically falls under gravity so as to pass a detector which detects the presence of objects of said particular kind. A separating mechanism is positioned in the path of the mixture downstream of the detector and is controllable by the output of the detector so as to cause objects of said particular kind to be directed in one direction and other objects to be directed in another direction.

In such an apparatus the separating mechanism typically comprises a bank of separating units each comprising a finger arranged for movement in response to the output of the detector. In known forms of such apparatus, although in each unit the operating means for moving the finger are normally housed in a casing, small particles not infrequently enter the casing in a sufficient quantity to interfere with the operation of the separating mechanism.

It is an object of the present invention to provide a separating mechanism wherein this difficulty is alleviated.

According to the present invention in a separating mechanism comprising at least one separating unit comprising a movable finger, operating means for moving said finger to effect a separating operation and a casing in which said operating means is housed, motion is transmitted between said operating means and said finger through the casing via a rotary member sealed to the casing by a rotary seal arrangement.

In one particular arrangement in accordance with the invention the operating means comprises a piston arranged for reciprocal motion and coupled to one end of a lever housed within the casing, said rotary member being in the form of a shaft coupled to the other end of said lever and arranged for rotation about its axis in response to movement of said piston.

In such an arrangement said shaft suitably extends through a planar portion of the casing and said seal arrangement includes a ring of resilient material sandwiched between the external face of part of the casing and an adjacent surface extending radially from said shaft.

The shaft is suitably arranged to extend through opposite parallel sides of the casing, a said rotary seal arrangement being provided at both places where the shaft extends through the casing.

The piston suitably comprises a unitary member pivotally connected with said lever and sealed to the internal wall of a co-operating cylinder by a flexible seal, the compliance of said flexible seal and the clearance between the piston and the internal surface of the cylinder being sufficient to accommodate the lateral movement of the piston which occurs as the piston moves along the cylinder.

The piston is suitably arranged to be moved pneumatically in one direction along the cylinder and to be moved in the other direction along the cylinder by spring housed within the cylinder.

One separating mechanism in accordance with the invention will now be described by way of example with reference to the accompanying drawings in which.

Figure 1:
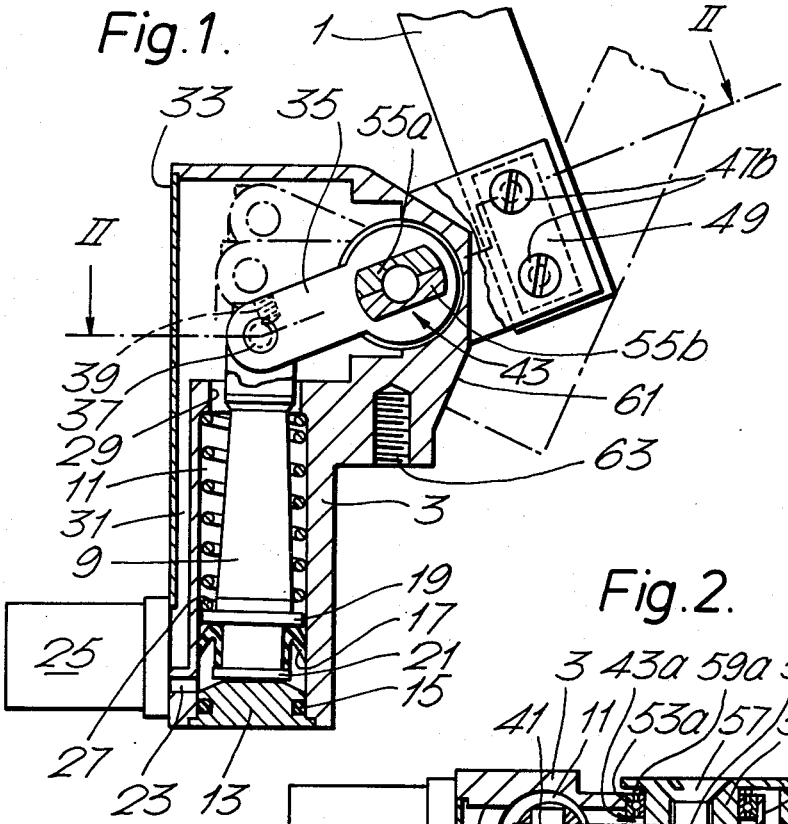
FIG. 1 is a sectional side view of a separating unit of the mechanism.
Figure 2:
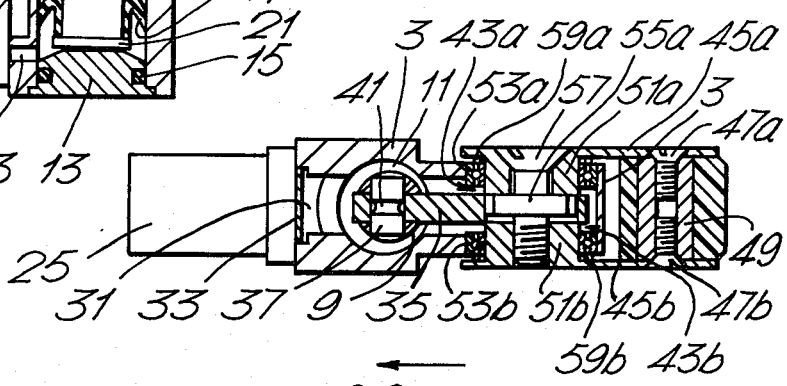
FIG. 2 is a sectional view along the line II—II in FIG. 1.

Referring to FIGS. 1 and 2, the separating unit comprises a finger 1, made for example of nylon, which is movable between a first normal position shown in dotted lines in FIG. 1 and a second position shown in full lines in FIG. 1. Movement of the finger 1 is effected by an operating means housed in a casing 3 under control of a detector (not shown) which detects the presence of objects to be separated.

Figure 3:
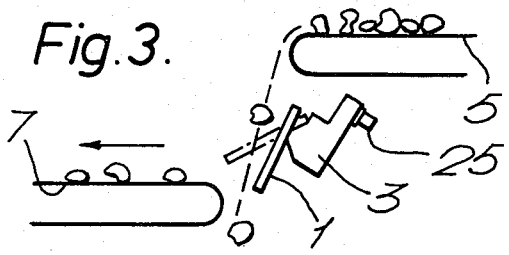
FIG. 3 illustrates the separating unit in use.

Referring to FIG. 3, in use the unit is disposed in the path of a mixture of objects of various kinds falling off the end of a moving conveyor 5 so that the falling objects are deflected by the finger 1 onto a second moving conveyor 7. When an object to be separated is detected, the finger 1 is temporarily moved to its second position to allow the detected object to fall past the finger 1 instead of being deflected onto the conveyor 7.

It will be appreciated that whilst in FIG. 3 a single separating unit only is shown, in practice a bank of units are normally used whose fingers are disposed in close spaced relation across the width of the conveyors, and a number of detectors are used which are similarly spaced across the width of the conveyors. Each detector may be arranged to control one or more fingers, and in a typical arrangement the detectors are positioned so as to appear to be between the fingers when viewed vertically, each detector controlling the fingers on either side of it.

Referring again to FIGS. 1 and 2, the operating means comprises a piston 9 which slides in a co-operating cylinder 11 constituted by a cylindrical bore in a part of the wall of the casing 3. The inner end of the cylinder 11 is closed by a plug 13 sealed to the remainder of the casing by an 'O' ring 15. The piston 9 is sealed to the internal wall of the cylinder 11 by an annular flexible seal 17 positioned at the inner end of the piston 9 between flanges 19 and 21. Compressed air is admissible to the inner end of the cylinder 11 via a passage 23 under control of a solenoid-operated three-port, normally open valve 25, thereby to move the piston 9 towards the open end of the cylinder 11 against the force of a helical spring 27 housed in the cylinder 11 and located between the flange 19 on the piston 9 and an inwardly extending flange 29 at the open end of the cylinder 11. To allow the piston 9 to return to the inner end of the cylinder 11 under the action of the spring 27 the valve 25 shuts off the supply of compressed air and connects the passage 23 with an exhaust gallery 31 within the casing 3. Air exhausted from the cylinder 11 leaks away to the atmosphere round the edges of a detachable cover plate 33 forming part of the casing 3.

At its outer end the piston 9 is pivotally connected to one end of a lever 35 by means of a bearing pin 37, the lever fitting in a slot formed in the end of the piston, and the pin being secured to the lever by a retaining screw 39 which co-operates with a groove 41 formed centrally on the pin.

At its end remote from the piston 9 the lever 35 is coupled to a rotary shaft 43 for rotation therewith.

The shaft 43 comprises two parts 43*a* and 43*b*, each of which parts if formed integrally with a respective driving plate 45*a* or 45*b*. The finger 1 is secured between the plates 45 to one side of the casing 3 by means of bolts 47 which screw into threaded holes in a metal insert 49 located in a hole in the end of the finger 1.

Each part 43*a* or 43*b* of the shaft includes a journal portion 51*a* or 51*b* which rotates in a bearing ring 53*a* or 53*b* secured in a circular hole formed in the adjacent part of the casing 3, bearings 53 thus constituting part of the casing. At the inner end of its journal portion 51*a* or 51*b* each part 43*a* or 43*b* of the shaft has a dog portion 55*a* or 55*b*, the two dog portions together fitting into a suitably shaped slot formed in the adjacent end of the lever 35. The two parts 43*a* and 43*b* of the shaft are clamped together by a screw 57. In the outer surface of each of the bearing rings 53*a* and 53*b* there is formed a circular groove in which an 'O' ring 59*a* or 59*b* is located, each 'O' ring being sandwiched between the outer face of its associated bearing ring 53*a* or 53*b* and the inner face of the adjacent driving plate 45*a* or 45*b*, thereby providing a rotary seal arrangement at each end of the shaft.

It will thus be seen that the whole of the unit except for the driving plates 45*a* and 45*b* and the finger 1 are housed within the casing 3. Due to the fact that the shaft 43 is sealed to the casing 3 at each end by a rotary seal arrangement wherein all relatively moving parts move in a direction at right angles to that in which particles must move to enter the casing, the ingress of particles through these seals is very unlikely. The likelihood of particles entering the casing 3 around the edge of the cover plate 33 is reduced by the outward passage of air at intervals in this region.

A further particular feature of the unit is that the compliance of the piston seal 17 is effectively used as a "big-end" bearing for the piston 9. Thus, as the piston 9 moves from one end of the cylinder 11 to the other, the end of the piston 9 coupled to the lever 35 follows an arcuate path of radius equal to the distance between the axis of the pin 37 and the axis of rotation of the shaft 43. Thus the piston 9 undergoes a measure of lateral movement as it moves along the cylinder 11, and the compliance of the piston seal 17 and the clearance between the piston 9 and the internal surface of the cylinder 11 are made sufficient to accommodate this movement. To facilitate this the piston 9 is tapered in diameter in a direction towards the open end of the cylinder 11.

Movement of the piston 9 along the cylinder 11 is limited by the piston 9 abutting the plug 13 for inward movement, and by the finger 1 abutting a portion 61 of the outer surface of the casing 3 for outward movement.

To facilitate mounting the unit alongside other units in a bank, a tapped hole 63 is provided in the casing.

Whilst in the particular embodiment described above, by way of example, the finger 1 is normally positioned in the path of the falling objects and is temporarily moved out of the path of the falling objects, a separating unit in accordance with the invention may be operated in other ways. For example, the finger may be arranged to be normally out of the path of the falling objects and be temporarily moved into the path of the falling objects. In such an arrangement the finger may be arranged to bat objects onto the conveyor 7 rather than simply deflect them.

It is further pointed out that whilst in the particular embodiment described above the finger moves pivotally, the finger may alternatively be arranged to move differently, e.g. linearly. An appropriate motion-conversion mechanism will, of course, then be required between the rotary member sealed to the casing and the finger.

I claim:

1. A separating mechanism comprising at least one separating unit comprising: a substantially closed casing; a movable finger disposed outside the casing; operating means housed in the casing for moving said finger to effect a separating operation; an axially rotatable shaft extending through the casing and coupled between said movable finger and said operating means whereby motion is transmitted from said operating means to said finger; and a rotary seal arrangement whereby said shaft is sealed to the casing.

2. A separating mechanism according to claim 1 wherein said movable finger is secured to said shaft to provide pivotal movement of the finger when said rotary member rotates.

3. A separating mechanism according to claim 1 wherein the operating means comprises a piston arranged for reciprocal motion and coupled to one end of a lever housed within the casing, said shaft being coupled to the other end of said lever and arranged for rotation about its axis in response to movement of said piston.

4. A separating mechanism according to claim 3 wherein said shaft extends through a planar portion of the casing and said seal arrangement includes a ring of resilient material sandwiched between the external face of part of the casing and an adjacent surface extending radially from said shaft.

5. A separating mechanism according to claim 4 wherein said shaft is arranged to extend through opposite parallel sides of the casing, a said rotary seal arrangement being provided at both places where the shaft extends through the casing.

6. A separating mechanism according to claim 3 wherein said piston comprises a unitary member pivotally connected with said lever and sealed to the internal wall of a co-operating cylinder by a flexible seal, the compliance of said flexible seal and the clearance between the piston and the internal surface of the cylinder being sufficient to accommodate the lateral movement of the piston which occurs as the piston moves along the cylinder.

7. A separating mechanism according to claim 6 wherein said piston is arranged to be moved pneumatically in one direction along the cylinder and to be moved in the other direction along the cylinder by a spring housed within the cylinder.

* * * * *